US011794057B2

(12) United States Patent
Thach et al.

(10) Patent No.: US 11,794,057 B2
(45) Date of Patent: Oct. 24, 2023

(54) EXERCISE APPARATUS

(71) Applicants: Minh Loi Thach, Alexander Heights (AU); John Hoogland, High Wycombe (AU)

(72) Inventors: Minh Loi Thach, Alexander Heights (AU); John Hoogland, High Wycombe (AU)

( * ) Notice: Subject to any disclaimer, the term of this patent is extended or adjusted under 35 U.S.C. 154(b) by 266 days.

(21) Appl. No.: 17/288,303

(22) PCT Filed: Jan. 11, 2021

(86) PCT No.: PCT/AU2021/000001
§ 371 (c)(1),
(2) Date: Apr. 23, 2021

(87) PCT Pub. No.: WO2021/142509
PCT Pub. Date: Jul. 22, 2021

(65) Prior Publication Data

US 2022/0054878 A1 Feb. 24, 2022

(30) Foreign Application Priority Data

Jan. 16, 2020 (AU) ..... 2020900122

(51) Int. Cl.
*A63B 21/008* (2006.01)
*A63B 21/00* (2006.01)

(52) U.S. Cl.
CPC ..... *A63B 21/0083* (2013.01); *A63B 21/0087* (2013.01); *A63B 21/154* (2013.01); *A63B 21/4035* (2015.10)

(58) Field of Classification Search
CPC ..... A63B 21/00069; A63B 2225/093; A63B 21/023; A63B 21/4035; A63B 21/00043; A63B 21/00076; A63B 21/008–0083; A63B 21/0085–0087; A63B 21/151; A63B 21/154–156; A63B 21/4033
See application file for complete search history.

(56) References Cited

U.S. PATENT DOCUMENTS 3,387,843 A * 6/1968 Chandler ..... A63B 21/154 482/113
4,720,103 A * 1/1988 Palladino, Jr. ..... A63B 69/34 473/438

(Continued)

*Primary Examiner* — Joshua Lee
*Assistant Examiner* — Catrina A Letterman
(74) *Attorney, Agent, or Firm* — Carrier, Shende & Associates P.C.; Joseph P. Carrier; Fulchand P. Shende

(57) ABSTRACT

An exercise apparatus comprises a frame with a chamber having a piston slidable between first and second cavity ends of the chamber, and a cable assembly for pulling the piston by an applied force towards the second cavity end to cause a vacuum in the chamber to exert a resistance force on the cable assembly. A cable subassembly extends between first and second parts of the cable assembly, comprising a pulley wheel attached to the first part and a cable extending around the pulley wheel having first and second cable ends. Stoppers on the cable ends engage a bearing member to restrain movement of at least the first cable end when the second cable end is pulled relative to the pulley wheel. Releasable connector means connect the cable ends to the second part to allow a user to choose a magnitude of the resistance force opposing the applied force.

20 Claims, 16 Drawing Sheets

(56) References Cited

U.S. PATENT DOCUMENTS

| | | | | |
|---|---|---|---|---|
| 4,746,115 | A | 5/1988 | Lahman | |
| 5,951,449 | A * | 9/1999 | Oppriecht | A63B 21/156 482/54 |
| 8,419,600 | B1 * | 4/2013 | Danowski | A63B 21/00061 482/112 |
| 10,265,572 | B2 * | 4/2019 | Bach | A63B 24/0087 |
| 2010/0081550 | A1 * | 4/2010 | Anderson | A63B 7/04 482/37 |
| 2012/0094804 | A1 * | 4/2012 | Bell | A63B 21/0083 482/99 |
| 2013/0296144 | A1 * | 11/2013 | Gvoich | A63B 21/0428 482/102 |
| 2016/0250514 | A1 * | 9/2016 | Gvoich | A63B 23/03541 482/102 |

* cited by examiner

EXERCISE APPARATUS

FIELD

The present invention relates to exercise apparatus and, more particularly, to exercise apparatus for resistance training.

BACKGROUND

Resistance training includes exercises that cause a person's muscles to contract against an external resistance force. Resistance training builds strength, muscle tone, mass and endurance and is used for sport, general health and rehabilitation purposes. Resistance training exercise machines typically comprise a set of weights that are selectively attachable to a moveable handle, bar or similar grippable device via a cable assembly. The cable assembly comprises a cable that extends around one or more pulley wheels attached to a supporting frame. When a user exerts an applied force on the handle causing it to move relative to the frame, the weights are lifted in an upwards direction and exert an opposing resistance force on the cable and handle.

Exercise machines of this configuration are problematic because if the user applies an explosive force on the handle causing the weights to be lifted rapidly, the weights continue to move upwards momentarily when the force is removed. When the weights subsequently fall down again they snag on the cable. The resulting momentum exchange causes the user to experience a sharp snapping or jerking action on the handle which can lead to them incurring sports injuries. These types of exercise machines are, therefore, not suitable for explosive weight training or plyometric exercises.

Furthermore, the resistance force provided by the weights only acts on the cable and handle when the handle is being moved over a limited travel distance. If the user tries to pull the handle relative to the supporting frame over a long distance, the weights rise to the top of the frame and stop the handle prematurely. Weight training exercises that require the grippable end of the cable to be pulled over relatively long distances, such as spider crawl exercises, cannot, therefore, be performed.

Other types of resistance training exercise machines comprise one or more elastic cables or bands fixed to a frame that are attached to a moveable handle. The handle is gripped by a user and pulled relative to the frame causing the elastic cables to stretch into tension. The magnitude of the elastic resistance force provided by the elastic cables increases the further the cables are stretched. These types of machines do not, therefore, provide a consistent resistance force over the full range of motion of the handle. These machines can lead to strain-related injuries being incurred by the user and are also unsuitable for plyometric and some rehabilitation exercises.

References to prior art documents in this specification are provided for illustrative purposes only and are not to be taken as an admission that such prior art is part of the common general knowledge in any country of the world.

SUMMARY

According to the present invention, there is provided exercise apparatus, comprising:

a frame;

at least one chamber supported by the frame, the chamber comprising an elongate internal cavity extending through the chamber;

a piston disposed in the internal cavity, wherein the piston is in a sealed airtight arrangement with an inner wall of the internal cavity and is adapted to slide back and forth between a first cavity end and a second cavity end of the internal cavity; and a cable assembly supported by the frame, wherein the cable assembly comprises a first end connected to the piston and at least a second end remote from the first end such that when an applied force is exerted on the second end, the piston is pulled by the cable assembly towards the second cavity end causing a vacuum to be created between the piston and the first cavity end, the vacuum thereby causing a resistance force that opposes the applied force to be exerted by the piston on the first end of the cable assembly, and wherein the cable assembly comprises at least one cable subassembly extending between first and second parts of the cable assembly, wherein the cable subassembly is configured to be pulled into tension by the applied force and by the resistance force and comprises:

a pulley wheel rotatably attached to the first part of the cable assembly;

a cable extending around the pulley wheel, wherein the cable comprises first and second cable lengths at respective opposed ends of the cable, wherein the cable lengths and the pulley wheel are arranged such that when either or both of the cable lengths is/are pulled relative to the pulley wheel, the cable causes the pulley wheel to move translationally relative to the frame and to exert a pulling force on the first part of the cable assembly;

first and second stoppers attached respectively to the first and second cable lengths, wherein at least the first of the stoppers is operatively configured to engage a bearing member provided on the exercise apparatus to restrain translational movement of the first of the cable lengths relative to the frame when only the second of the cable lengths is pulled relative to the pulley wheel; and releasable connector means configured to connect either or both of the cable lengths releasably to the second part of the cable assembly to allow a user of the exercise apparatus to choose a magnitude of the resistance force that is transferred to the second part of the cable assembly by the cable subassembly and experienced by the user against the applied force.

The first part of the cable assembly may comprise a coupling device attached to the piston, wherein the pulley wheel is rotatably attached to the piston by the coupling device, and wherein the coupling device and pulley wheel are dimensioned to fit inside the internal cavity and slide along the internal cavity with the piston, and wherein the cable lengths extend out from the chamber via an end of the chamber to connect to the second part of the cable assembly.

The first and second cable lengths may extend around, respectively, first and second pulley wheels provided underneath the end of the chamber before extending to the second part of the cable assembly.

The first and second cable lengths may extend through, respectively, first and second apertures provided in a support arrangement disposed adjacent the chamber, wherein the support arrangement provides the bearing member.

The chamber may comprise a cover extending laterally across the internal cavity below the piston, wherein the cover comprises first and second apertures that receive, respectively, the first and second cable lengths.

The coupling device may be configured such that a rotational axle of the pulley wheel can swivel relative to the piston about an axis extending longitudinally through the piston.

The exercise apparatus may comprise a tensioning mechanism for tensioning the cable assembly.

The tensioning mechanism may comprise a moveable pulley wheel that engages an individual cable of the cable assembly to tension the individual cable, wherein the moveable pulley wheel is slidable along an elongate track provided on the frame.

The moveable pulley wheel may be slidably connected to the elongate track by a bracket arrangement, wherein the bracket arrangement comprises a locking mechanism for locking the moveable pulley wheel in position relative to the elongate track.

The locking mechanism may comprise a pin slidably supported by the bracket arrangement that is releasably engageable into a plurality of apertures provided on the elongate track.

The pin may be slidable between an engagement condition for engaging with one of the apertures provided on the elongate track and a release condition for moving the bracket arrangement relative to the elongate track, and wherein the pin is spring loaded to bias the pin towards the engagement condition.

The tensioning mechanism may further comprise an elongate screw thread rotatably supported by the frame, wherein the elongate screw thread is received by a threaded aperture provided in the bracket arrangement.

The elongate screw thread may comprise a handle for turning the elongate screw thread.

The second end of the cable assembly may comprise a handle, and the cable assembly may also comprise a further cable subassembly that extends between the second part of the at least one cable subassembly and the handle, wherein the further cable subassembly is operatively identical to the at least one cable subassembly and comprises a further cable having first and second further cable lengths that are releasably connectable to the handle.

The exercise apparatus may comprise a carriage assembly slidably supported by an elongate frame member of the frame, wherein the further cable lengths threadedly extend through the carriage assembly and are arranged such that the further cable stays extended around a pulley wheel of the further cable subassembly when the carriage assembly moves slidably along the elongate frame member.

The carriage assembly may comprise a locking mechanism for locking the carriage assembly in position relative to the elongate frame member when the carriage assembly has been moved to a desired height.

The further cable lengths may extend away from the carriage assembly in opposed directions and around at least a pair of pulley wheels disposed at, respectively, upper and lower ends of the frame, wherein the further cable lengths are continuously joined and extend around the pulley wheel of the further cable subassembly.

The exercise apparatus may also comprise:

- a second chamber supported by the frame, the second chamber comprising an elongate internal cavity extending through the second chamber;
- a further piston disposed in the internal cavity of the second chamber, wherein the further piston is in a sealed airtight arrangement with an inner wall of the internal cavity of the second chamber and is adapted to slide back and forth between a first cavity end and a second cavity end of the internal cavity of the second chamber, wherein the cable assembly comprises a further cable subassembly for releasably connecting the further piston to the second end of the cable assembly.

The present invention also provides an exercise machine comprising a pair of exercise devices connected together, wherein each of the exercise devices comprises the exercise apparatus described above.

BRIEF DESCRIPTION OF DRAWINGS

Embodiments of the invention will now be described by way of example only with reference to the accompanying drawings, in which.

DESCRIPTION OF EMBODIMENTS

Figure 1:
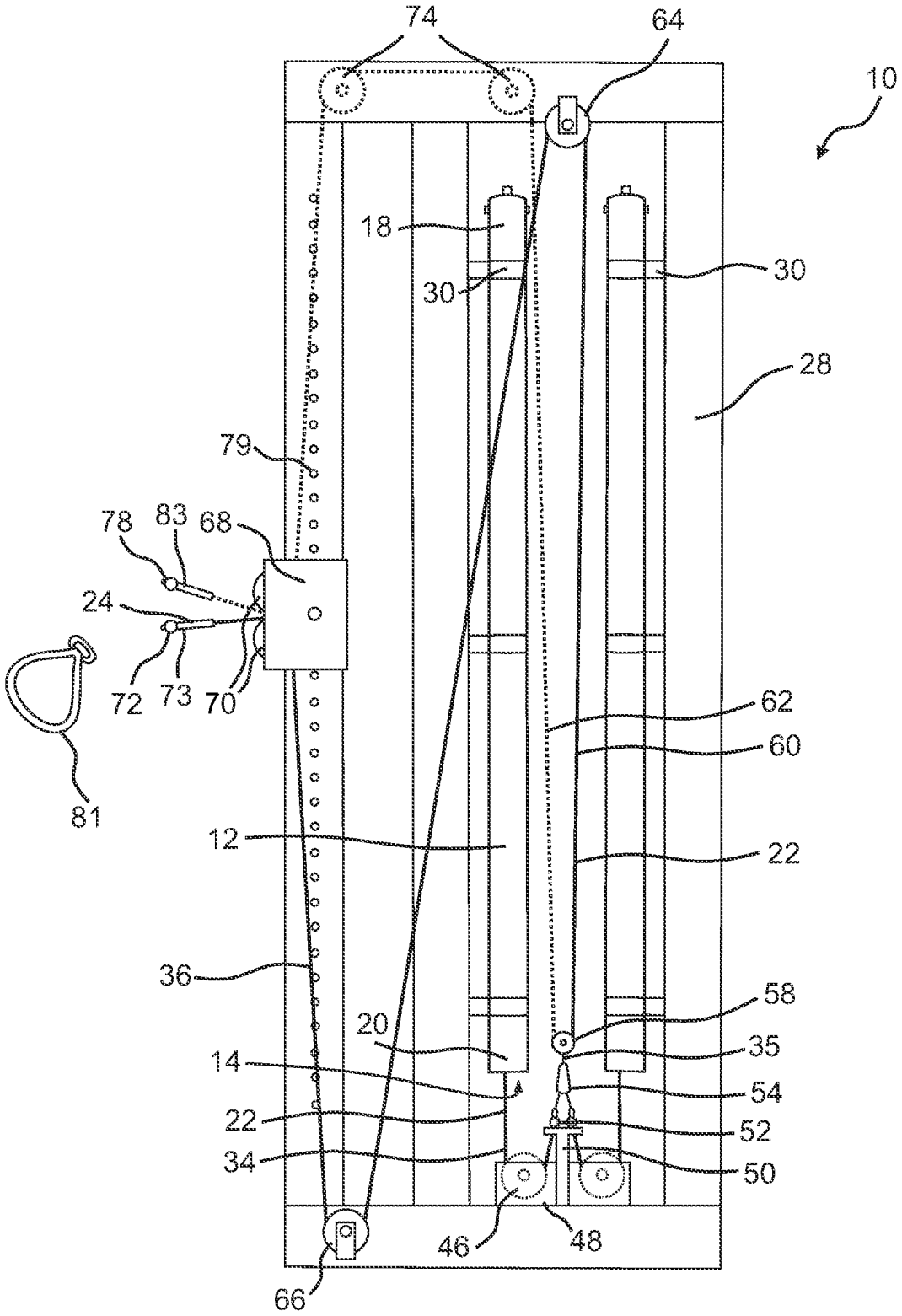
FIG. 1 is first side elevation view of an exercise apparatus according to an example embodiment of the invention.

Referring to FIGS. 1 to 7, an example embodiment of the present invention provides an exercise apparatus 10 comprising a frame 28, at least one chamber 12 supported by the frame 28, wherein the chamber 12 comprises an elongate internal cavity 14 extending through the chamber 12. The exercise apparatus 10 also comprises a piston 16 disposed in the internal cavity 14, wherein the piston 16 is in a sealed airtight arrangement with an inner wall of the internal cavity 14 and is adapted to slide back and forth between a first cavity end 18 and a second cavity end 20 of the internal cavity 14. The exercise apparatus 10 also comprises a cable assembly 22 supported by the frame 28, wherein the cable assembly 22 comprises a first end 31 connected to the piston 16 and at least a second end 72 remote from the first end 31. The cable assembly 22 is configured such that when an applied force is exerted on its second end 72, the piston 16 is pulled by the cable assembly 22 towards the second cavity end 20 to cause a vacuum to be created between the piston 16 and the first cavity end 18, the vacuum thereby causing a resistance force that opposes the applied force to be exerted by the piston 16 on the first end 31 of the cable assembly 22.

The cable assembly 22 comprises at least one cable subassembly 34 that extends between a first part 33 and a second part 35 of the cable assembly 22, wherein the cable subassembly 34 is arranged and configured such that it is pulled into tension by the applied force and by the resistance force in use. The cable subassembly 34 also comprises a pulley wheel 32 rotatably attached to the first part 33 of the cable assembly 22 and a cable 38 extending around the pulley wheel 32. The cable 38 comprises first and second cable lengths 40, 42 at respective opposed ends of the cable 38. The cable lengths 40, 42 and the pulley wheel 32 are arranged such that when either or both of the cable lengths 40, 42 is/are pulled relative to the pulley wheel 32, the cable 38 causes the pulley wheel 32 to move translationally relative to the frame 28 and to exert a pulling force on the first part 33 of the cable assembly 22.

The at least one cable subassembly 34 also comprises first and second stoppers 52 attached respectively to the first and second cable lengths 40, 42. A first of the stoppers 52 is operatively configured to engage a bearing member 50 provided on the exercise apparatus 10 to restrain translational movement of the first of the cable lengths 40 relative to the frame 28 when only the second of the cable lengths 42 is pulled relative to the pulley wheel 32. Similarly, the second of the stoppers 52 is operatively configured to engage the bearing member 50 to restrain translational movement of the second of the cable lengths 42 relative to the frame 28 when only the first of the cable lengths 40 is pulled relative to the pulley wheel 32. The cable subassembly 34 also comprises releasable connector means 54 configured to connect either or both of the cable lengths 40, 42 releasably to the second part 35 of the cable assembly 22 to allow a user of the exercise apparatus 10 to choose a magnitude of the resistance force that is transferred to the second part 35 of the cable assembly 22 by the cable subassembly 34 and experienced by the user against the applied force.

More particularly, in the example depicted the frame 28 comprises a pair of chambers 12 that are attached to frame members of the frame 28 by a plurality of braces 30. The chambers 12 may be vertically aligned and extend longitudinally between upper and lower ends of the frame 28. The cable assembly 22 may comprise at least two separate cable subassemblies that are connectable together—namely, a first cable subassembly 34 and a further (second) cable subassembly 36. The first cable subassembly 34 may extend into the first of the two chambers 12 and be connected to the piston 16 of the first chamber 12. The second cable subassembly 36 may be connectable to the first cable subassembly 34 and extend up to the second end 72 of the cable assembly 22.

Figure 4:
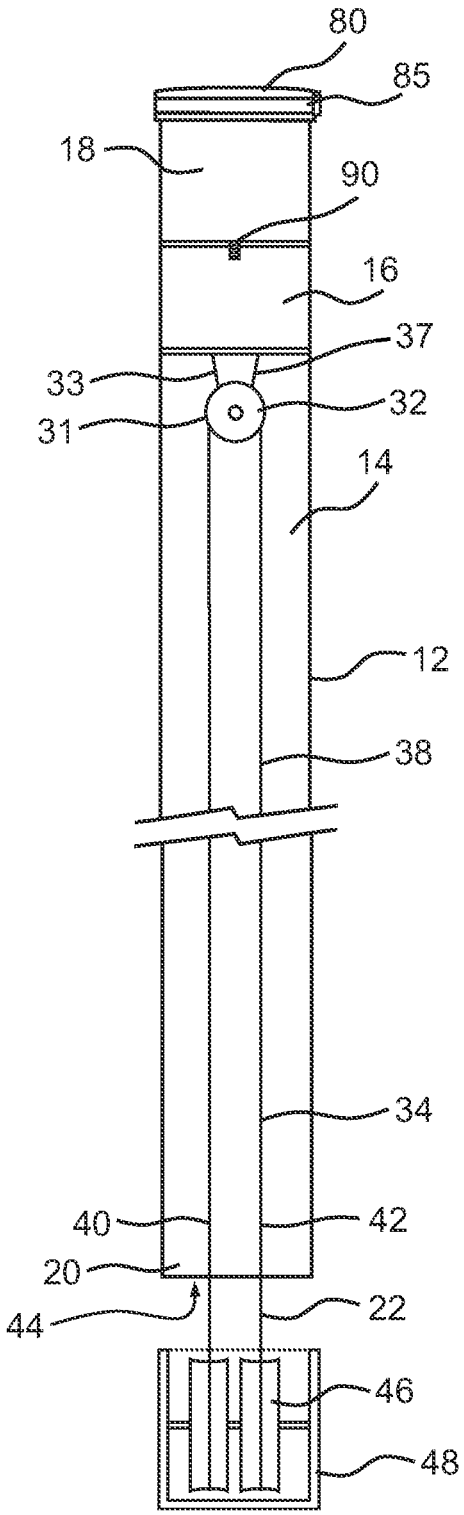
FIG. 4 is cross sectional side elevation view of an individual chamber of the exercise apparatus.

As shown in FIG. 4, the first cable subassembly 34 may be connected to the piston 16 of the first chamber 12 via a coupling device 37. The coupling device 37 may be connected to a lowermost end of the piston 16 and face the second cavity end 20 of the chamber 12. The pulley wheel 32 of the first cable subassembly 34 may be dimensioned such that it fits inside the elongate internal cavity 14 of the chamber 12 and is slidable along the longitudinal axis of the internal cavity 14 together with the piston 16. The second cable subassembly 36 may be operatively connectable to the first cable subassembly 34 and may comprise a grippable end 24 of the cable assembly 22 that is provided with a handle. When a pulling force is exerted by a user of the apparatus 10 on the handle 24, the second cable subassembly 36 exerts a corresponding pulling force on the first cable subassembly 34. Consequently, the first cable subassembly 34, in turn, exerts a corresponding downwards pulling force on the piston 16.

The first cable subassembly 34 may comprise a single cable 38 that extends over and around the pulley wheel 32 in the chamber 12. Two adjacent lengths 40, 42 of the cable 38 may extend from either side of the pulley wheel 32 downwardly through the internal cavity 14 in parallel alignment towards the second cavity end 20. The two cable lengths 40, 42 may exit from the chamber 12 via an aperture 44 provided at the lowermost end of the chamber 12. The two cable lengths 40, 42 may then extend around a pair of parallel-aligned pulley wheels 46 rotatable supported by a block support 48 located underneath the second cavity end 20.

Figure 5:
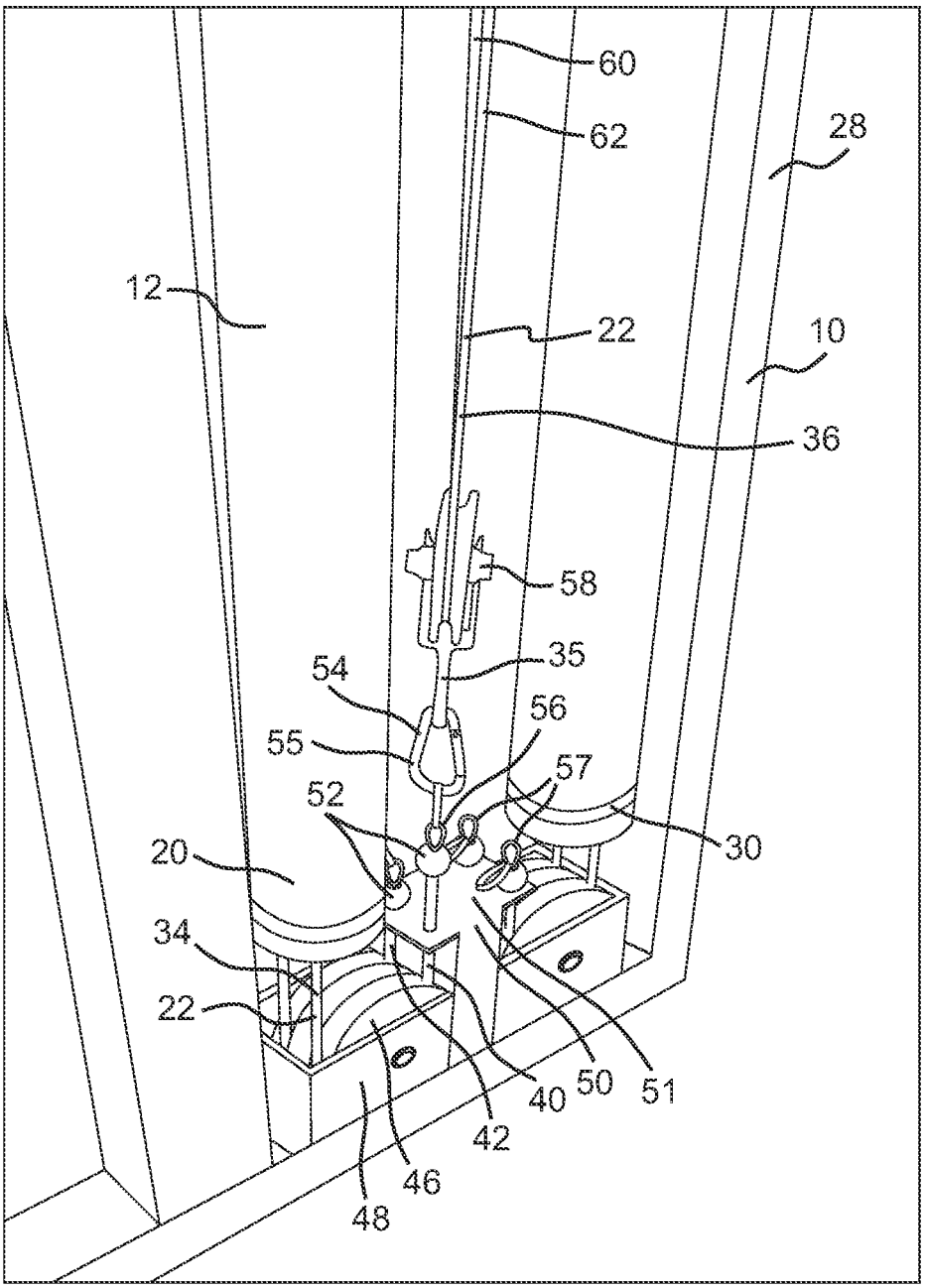
FIG. 5 is an enlarged perspective view of a base end of the exercise apparatus.

Referring to FIG. 5, the two cable lengths 40, 42 may upwardly extend out of the two pulley wheels 46 terminating at first and second cable ends. The two cable ends may upwardly extend to a support arrangement 51 that is adjacent to the chamber 12. The support arrangement 51 may comprise a T-shaped structure comprising a laterally aligned flat uppermost surface that is held above a base end of the frame 28 by one or more vertical supports. The two ends of the cable lengths 40, 42 may extend through the flat uppermost surface of the support arrangement 51 via a pair of apertures formed in the uppermost surface and comprise stoppers 52 attached to their extremities. The stoppers 52 may comprise spherical bodies that are positioned above the support arrangement 51. The flat uppermost surface of the support arrangement 51 operates as a bearing member and stops the cable ends 40, 42 from being pulled downwardly through the apertures of the uppermost surface in use.

The apparatus 10 may also comprise a connection mechanism that allows either or both of the two cable lengths 40, 42 of the first cable subassembly 34 to be connected releasably to the second cable subassembly 36. For example, the apparatus 10 may comprise a clip 55, such as a carabiner clip, connected to the second cable subassembly 36 that is releasably connectable to retainer loops 56 outwardly protruding from the stoppers 52. The clip 55 may be connected selectively to one or both of the retainer loops 56 in use. In the example that is depicted, the clip 55 is indirectly connectable to each retainer loop 56 via a small subloop that is connected to each retainer loop 56. In other examples, the clip 55 may be directly connectable to each retainer loop 56.

When the piston 16 is pulled down through the cavity 14 of the chamber 12, a vacuum is formed in the cavity 14 between the piston 16 and the first cavity end 18. The vacuum causes an opposing resistance force to be exerted on the piston 16 in an upwards direction due to atmospheric pressure acting on the lowermost surface of the piston 16. The resistance force is transferred to the second end 35 of the cable assembly 22 by the first cable subassembly 34. When the user pulls on the handle 24 of the second cable subassembly 36, the number of retainer loops 56 that are connected to the clip 55 determines the level of effort that must be exerted by the user to overcome the resistance force provided by the piston 16 and cause the piston 16 to move down the chamber 12. For example, when only one retainer loop 56 is connected to the clip 55, pulling on the handle 24 causes only one (a first) of the cable lengths 40, 42 to be pulled by the clip 55 away from the bearing member 50. In turn, the other (second) of the cable lengths 40, 42 engages the bearing member 50 thus causing a downwards pulling force to be exerted by the cable 38 on the pulley wheel 32.

In contrast, when both of the retainer loops 56 are connected to the clip 55, pulling on the grippable end 24 causes both of the cable lengths 40, 42 to be pulled by the clip 55 away from the bearing member 50. When both of the retainer loops 56 are connected to the clip 55, the level of effort that must be exerted by the user on the grippable end 24 to overcome the resistance force and cause the piston 16 to move is generally double the effort required when just one of the retainer loops 56 is connected to the clip 55. The clip 55 and retainer loops 56, therefore, allow the user to put the apparatus 10 into one of two different resistance settings.

The cable assembly 22 may also comprise a third cable subassembly that extends into the piston that is slidably disposed in the second of the two chambers 12. The third cable subassembly may comprise a pair of cable ends also provided with retainer loops 57 that are also selectively connectable to the clip 55. In this configuration, the two sets of retainer loops 56, 57 allow the user to put the apparatus 10 selectively into one of four different resistance settings.

The second cable subassembly 36 may be operatively identical to the first cable subassembly 34 and, therefore, allow the user to put the apparatus 10 into further resistance setting modes. More particularly, the second cable subassembly 36 may comprise a vertically movable pulley wheel 58 that is connected to the carabiner clip 55. The pulley wheel 58 may be moveable up and down along a vertical travel path between the pair of chambers 12. A single cable may extend around the pulley wheel 58 that has first and second upwardly extending cable lengths 60, 62. Referring to FIG. 1, the first cable length 60 may extend from the moveable pulley wheel 58 up towards, and around, a single pulley wheel 64 rotatably attached to an uppermost support member of the frame 28. The first cable length 60 may then extend diagonally down towards, and around, a single pulley wheel 66 rotatably attached to a lowermost support member of the frame 28. The first cable length 60 may then extend from the pulley wheel 66 up towards a carriage assembly 68.

Figure 3:
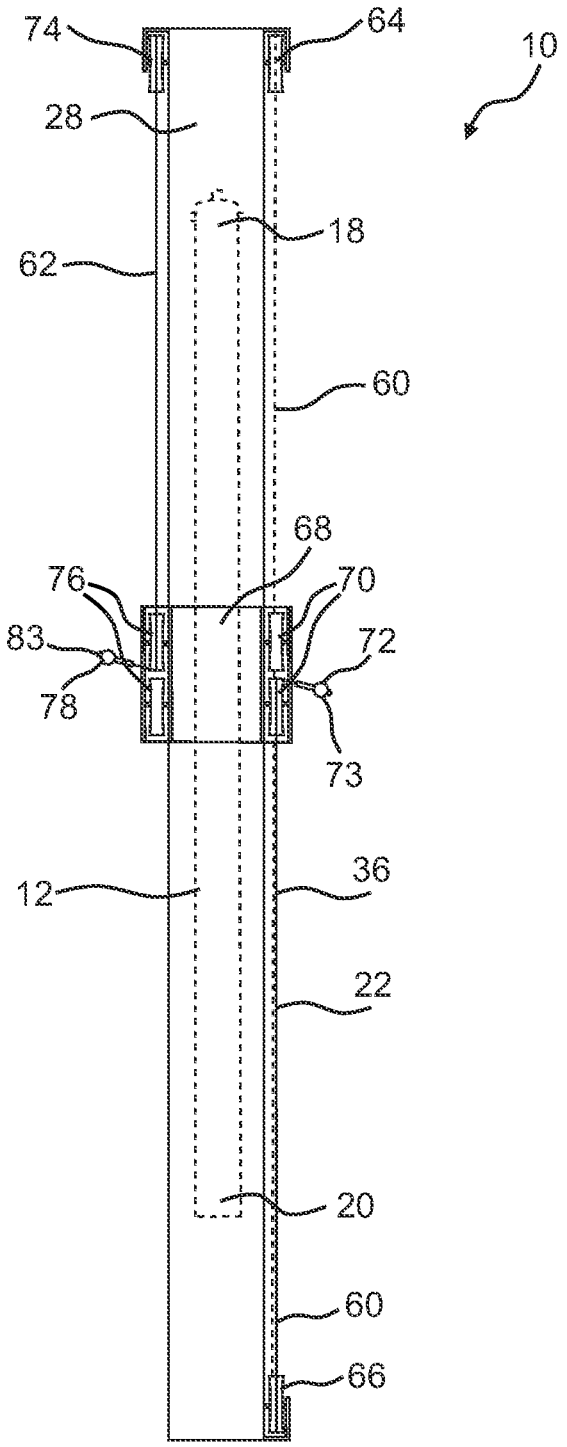
FIG. 3 is a front elevation view of the exercise apparatus.

The carriage assembly 68 may be slidably connected to a vertically aligned elongate frame member of the frame 28 at the frontmost end of the frame 28. The first cable length 60 may extend threadedly between a first pair of pulley wheels 70 attached to the carriage assembly 68. As shown in FIG. 3, the pair of pulley wheels 70 may be stacked vertically. A terminating end of the first cable length 60 extending out from the pulley wheels 70 may have a handle 73 attached thereto. The handle 73 is accessible from the frontmost end of the frame 28 and, therefore, provides the grippable end 24 of the second cable subassembly 36.

Figure 2:
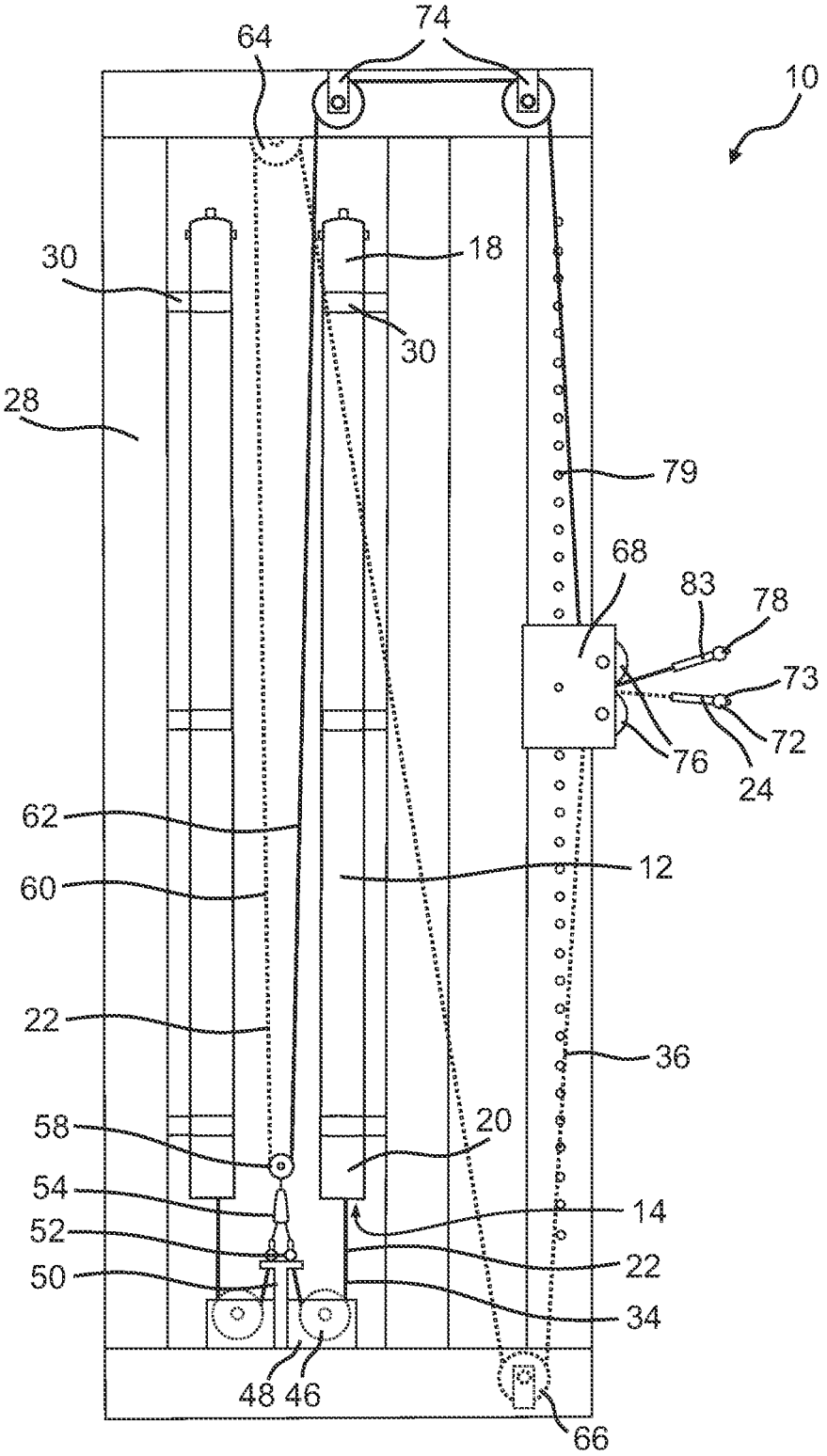
FIG. 2 is a second side elevation view of the exercise apparatus.

Referring to FIG. 2, the second cable length 62 may extend from the moveable pulley wheel 58 up towards, and around, a pair of pulley wheels 74 rotatably attached to the uppermost support member of the frame 28. The pair of pulley wheels 74 may be attached to the support member on the opposite side of the frame 28 that the single pulley wheel 64 is attached to. The second cable length 62 may then extend down towards the slidably carriage assembly 68 and threadedly extend between, and through, a second pair of pulley wheels 76 that are attached to the carriage assembly 68 in a vertically stacked arrangement. A terminating end of the second cable length 62 may comprise a second handle 83 attached thereto. In this configuration, the two handles 73, 83 together provide the grippable end 24 of the second cable subassembly 36.

Referring to FIG. 3, in the example depicted the first and second pairs of pulley wheels 70, 76 are rotatably attached to respective outermost sides of the carriage assembly 68. However, in other examples, each pair of pulley wheels 70, 76 may be rotatably attached within a mounting bracket (not shown) that is, in turn, hingedly connected to the carriage assembly 68. Each mounting bracket may be rotatable about a vertical axis aligned parallel with the frontmost support member of the frame 28. In this configuration, the user of the exercise apparatus 10 may pull the handles 73, 83 away from the carriage assembly 68 at variable angles.

The arrangement of pulleys 64, 66, 70, 74, 76 provides that when either one of, or both of, the handles 73, 83 are pulled by the user away from the carriage assembly 68, the moveable pulley wheel 58 is pulled upwardly away from the base end of the frame 28 by the second cable subassembly 36. The carriage assembly 68 operates as the bearing member of the second cable subassembly 36 such that when only one of the handles 73 is pulled by the user, the relevant second handle 83 is pulled towards the carriage assembly 68 and is restrained by the carriage assembly 68. When both of the handles 73, 83 are pulled by the user simultaneously, the effort that is required to hoist the moveable pulley wheel 58 is substantially double the effort required when just one of the handles 73, 83 is pulled by the user individually. The cable assembly 22 may be provided with a single master handle 81 that the two handles 73, 83 may be selectively attachable to. The single handle 81 may be used to pull both handles 73, 83 simultaneously or used to pull just one of the handles 73, 83 individually. The arrangement of the handles 73, 83, 81 and the two sets of retainer loops 56, 57, therefore, provide eight different combinations that the user may choose from when configuring the apparatus 10.

The carriage assembly 68 may be slidably connected to the frontmost elongate frame member of the frame 28 such that it can be moved up or down by the user to a required height. The carriage assembly 68 may also comprise a locking mechanism for locking the carriage assembly 68 in position relative to the frame member when it has been moved to a desired height. For example, the frontmost frame member may comprise a plurality of apertures 79 arranged at regular spaced intervals along its vertical length that each extend laterally through the frame member. The carriage assembly 68 comprises an aperture formed in its side that receives a pop pin with a spring loaded plunger. When the carriage assembly 68 has been moved to a desired height, the pop pin may be pushed through the carriage assembly 68 and into the nearest aperture 79 in the frontmost frame to secure the carriage assembly 68 in position.

The first and second cable lengths 60, 62 may be arranged such that they extend away from the carriage assembly 68 in opposed directions before extending around the relevant pulley wheels 66, 74 at the, respectively, lowermost and uppermost ends of the frame 28. In this arrangement, the carriage assembly 68 may be moved up and down freely and, at all times, the cable lengths 60, 62 remain extended around the moveable pulley wheel 58 and threaded through the carriage assembly 68.

Referring to FIG. 4, a cross sectional side view of an individual chamber 12 of the exercise apparatus 10 is provided. The chamber 12 may comprise a cap 80 that is removably attached to the first cavity end 18 using a hose clamp 85. The cap 80 may be removed periodically to provide access to the internal cavity 14 of the chamber 12. For example, the cap 80 may be removed to allow lubricant to be applied into the cavity 14 during maintenance of the exercise apparatus 10.

Figure 6A:
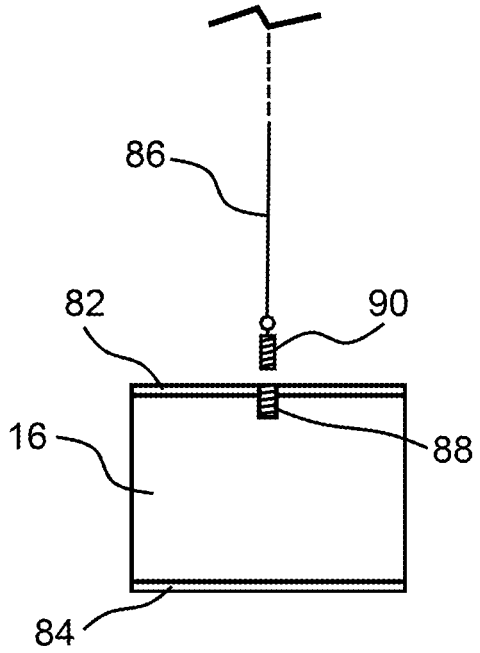
FIGS. 6(*a*) and (*b*) are cross sectional side elevation views of a piston of a chamber of the exercise apparatus.
Figure 6B:
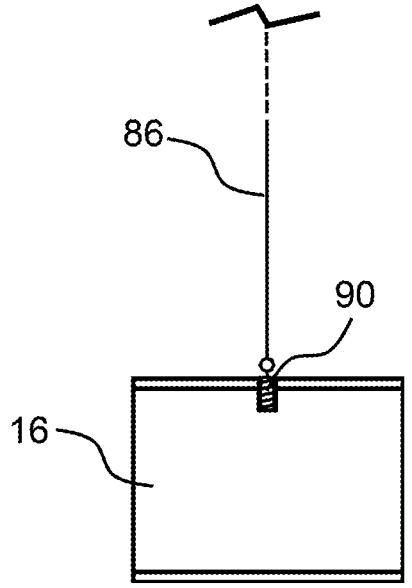

Referring to FIGS. 6(*a*) and 6(*b*), the piston 16 may comprise a pair of seal members 82, 84 disposed at opposed uppermost and lowermost ends of the piston 16. The seal members 82, 84 may comprise annular rubber gaskets that keep the piston 16 in an airtight sealed arrangement with an inner wall of each chamber 12. The piston 16 may be provided with a pair of grooves (not shown) that circumferentially extend around its uppermost and lowermost ends that receive the annular rubber gaskets. During maintenance of the apparatus 10, the piston 16 may periodically need to be removed from the chamber 12 or moved down towards the lowermost end of the chamber 12 towards the second cavity end 20. After the relevant maintenance work has been carried out, the piston 16 will then need to be moved back up to the first cavity end 18. To allow this to be done conveniently, the exercise apparatus 10 may also comprise a cord 86 that is releasably attachable to the piston 16. In the example depicted, the piston 16 comprises a threaded aperture 88 in its uppermost end that is adapted to receive an eye bolt 90 that the cord 86 may be tied to. With the cap 80 removed, the cord 86 may be lowered down into the chamber 12 from the first cavity end 18 and attached to the piston 16. Pulling on the cord 86 then causes the piston 16 to be pulled up towards the first cavity end 18. Once in position, the cap 80 may then be reattached to the first cavity end 18 using the hose clamp 85.

In use, a user of the exercise apparatus 10 may connect one or more of the retainer loops 56, 57 to the carabiner clip 55 selectively depending on the required resistance setting. Connecting the clip 55, in turn, connects the second cable subassembly 36 to one or more of the pistons 16 of the chambers 12. The user may then stand at the frontmost end of the frame 28 and, if necessary, adjust the carriage assembly 68 to a required height. The user may then hold onto and pull either handle 73, 83 away from the carriage assembly 68 (or both handles 73, 83 using the master handle 81) to perform resistance-based exercises.

Figure 7:
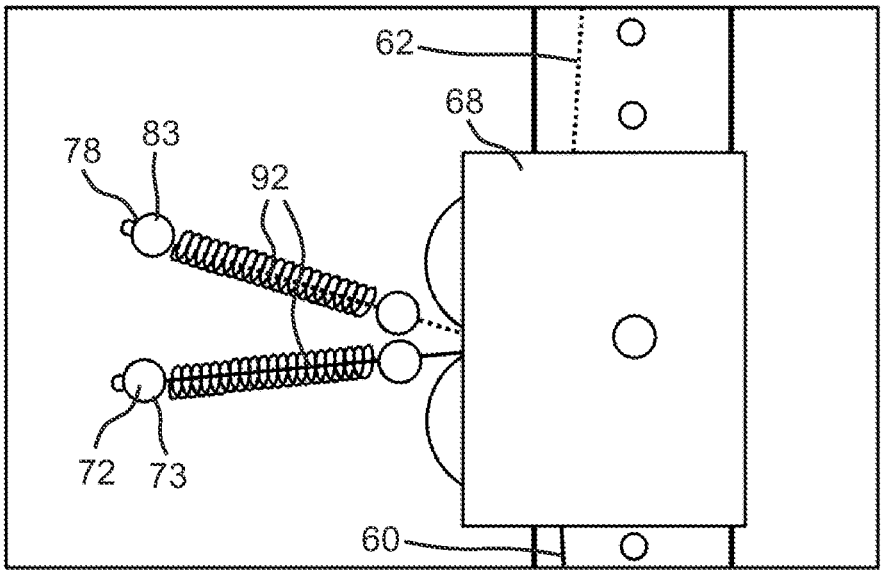
FIG. 7 is an enlarged side elevation view of a pair of handles that may be included in the exercise apparatus.

In the example depicted, each handle 73, 83 comprises a simple handgrip that may be grasped by the user. Referring to FIG. 7, in other examples the handles 73, 83 may comprise a pair of springs 92 that are threaded onto the ends of the two cable lengths 60, 62 between a pair of spherical stoppers. When the clip 55 of the exercise apparatus 10 needs to be connected or disconnected to/from one of the retainer loops 56, 57, the user of the apparatus 10 may push the outermost stoppers of the handles 73, 83 towards the carriage assembly 68. This causes the springs 92 to compress and lowers the moveable pulley wheel 58 and clip 55 down towards the retainer loops 56, 57.

In other examples, other grippable handle devices may be used with the exercise apparatus 10. For example, a single handlebar may be attached onto either or both of the handles 73, 83 via retainer loops and carabiner clips (not shown) secured onto the ends of the handles 73, 83. In other examples, the two cable lengths 60, 62 of the second cable subassembly 36 may extend away from the carriage assembly 68 and be connected to a separate exercise machine or device, such as a rowing machine, disposed next to the exercise apparatus 10.

When the handles 73, 83 are pulled away from the carriage assembly 68 during the exercise, the second cable subassembly 36 hoists the moveable pulley wheel 58 in an upwards direction. In turn, the relevant cable ends 40, 42 that are attached to the carabiner clip 55 via the retainer loops 56, 57 are pulled upwardly away from the support arrangement 51. The relevant connected pistons 16 are, consequently, pulled downwardly through the relevant chambers 12 towards the second cavity ends 20. The user's pulling force is opposed by the vacuum that forms in the internal cavity 14 thus requiring the user to overcome a resistance force. The pistons 16 have negligible momentum when they are sliding through the chambers 12. Therefore, when the user stops applying a pulling force on the handles 73, 83, the opposing resistance force that is provided by the vacuum in the chambers 12 advantageously acts on the cable assembly 22 immediately, or substantially immediately. The handles 73, 83 are immediately pulled back towards the carriage assembly 68 so the user does not experience any snaping or jerking of the cable assembly 22 as commonly encountered in weight-based resistance training systems. The magnitude of the resistance force that is provided by the vacuum in the chambers 12 changes by a negligible amount only when the handles 73, 83 are pulled away from the apparatus 10. The apparatus 10 is, therefore, advantageously suitable for performing explosive plyometric exercises and for rehabilitation exercises.

The cable assembly 22 that connects the handles 73, 83 to the pistons 16 is configured such that the cable assembly 22 extends, in part, into each of the internal cavities 14 of the chambers 12 when the pistons 16 slide towards the first cavity ends 18. This feature advantageously enables the handles 73, 83 to be pulled away from the carriage assembly 68 by a substantial distance. In effect, the cable assembly 22 allows the longitudinal lengths of the chambers 12 to be used substantially in full. Resistance training exercises that require the handles 73, 83 to be pulled over relatively long distances, such as spider crawl exercises, can, therefore, be performed.

Further, the user may advantageously modify the resistance force that is experienced during an exercise using two alternative methods. Firstly, the user may choose to pull one, or both, of the handles 73, 83 away from the carriage assembly 68. When both of the handles 73, 83 are pulled away rather than just one, the effort that is required to hoist the vertically moveable pulley wheel 58 is substantially doubled. Consequently, the user is required to pull twice as hard on the handles 73, 83 to overcome the resistance force acting on the piston 16. Secondly, the user may choose to modify the resistance force by attaching the carabiner clip 55 to a different number (or combination) of retainer loops 56, 57. For example, the carabiner clip 55 may be connected such that just one, or both, of the pistons 16 are connected to the second cable subassembly 36. Further, for an individual chamber 12, the user may attach the carabiner clip 55 such that either or both of the relevant cable ends 40, 42 connected to the piston 16 of the individual chamber 12 are connected to the second cable subassembly 36. For any given chamber 12, the effort that must be exerted by the user to overcome the vacuum in the chamber 12 when both of the cable ends 40, 42 of the chamber 12 are connected to the clip 55 is substantially double the effort required when only one of the cable ends 40, 42 is connected. The exercise apparatus 10, therefore, provides the user with two alternative handle 73, 83 combinations and four different connective combinations between the carabiner clip 55 and retainer loops 56, 57 to choose from. In total, this provides the user with eight different combinations to choose from when configuring the apparatus 10.

Figure 8:
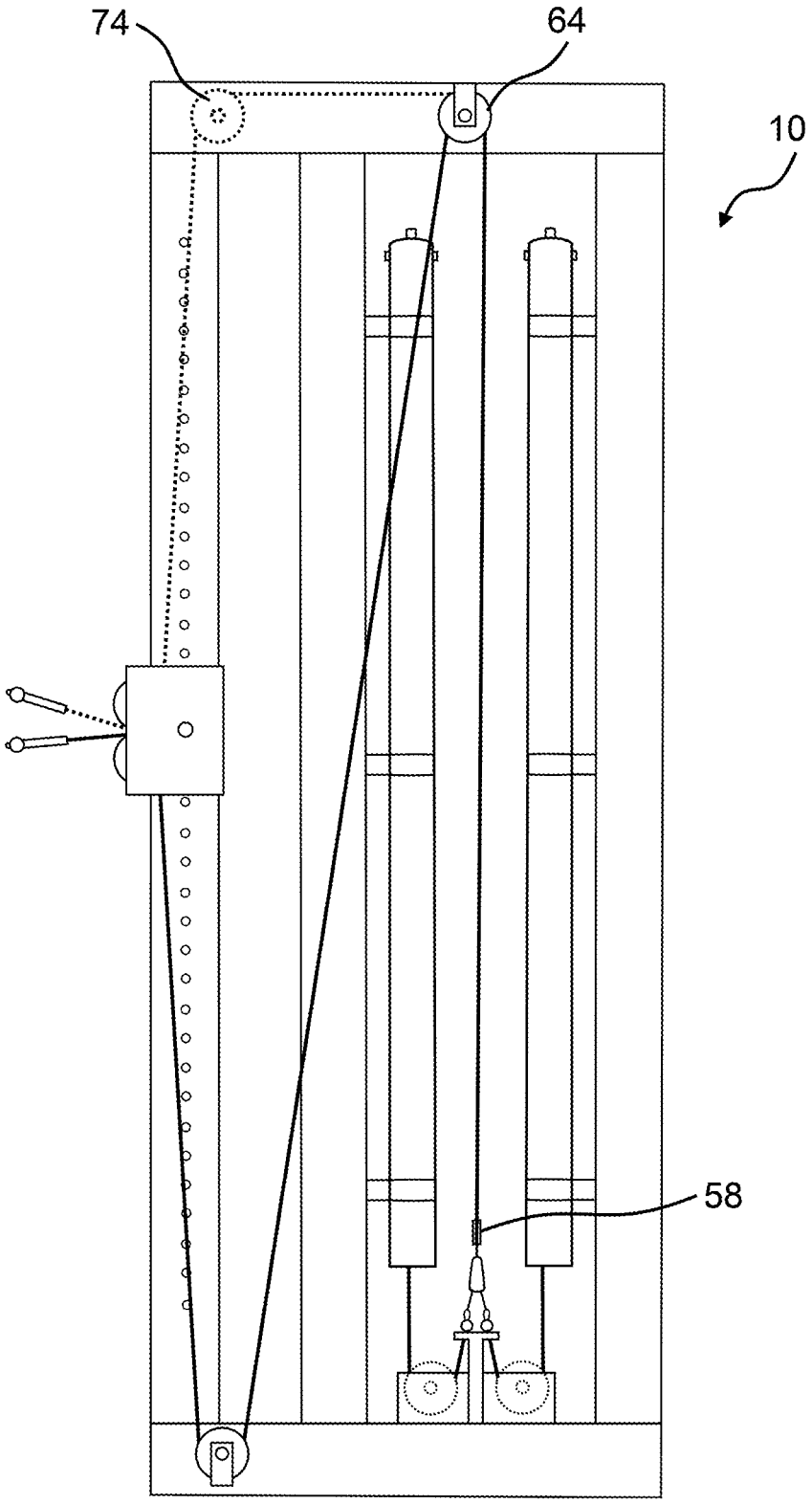
FIG. 8 is a side elevation view of an exercise apparatus according to a further example embodiment of the invention.

In FIG. 1, in order to illustrate the structure and operating function of the cable assembly 22 clearly, the pulley wheel that is labelled 64 and the rightmost of the two pulley wheels labeled 74 are shown attached to the uppermost support member of the frame 28 at different horizontal positions. Further, the moveable pulley wheel 58 is shown such that its axis of rotation extends inwardly into FIG. 1. As depicted in FIG. 8, in other examples the two pulley wheels 64, 74 may be aligned such that they are attached to the uppermost support member at the same horizontal position. In use, the moveable pulley wheel 58 may be aligned such that its axis of rotation extends horizontally parallel with the sides of the exercise apparatus 10.

Figure 9:
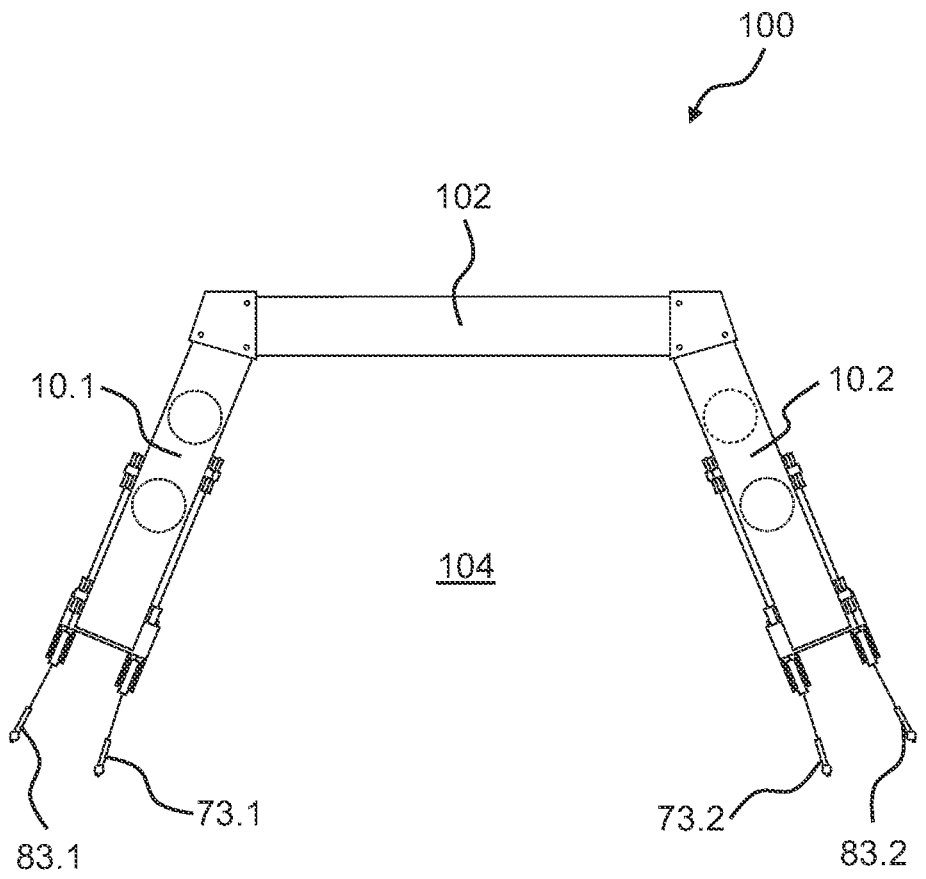
FIG. 9 is a top view of an exercise machine according to a further example embodiment of the invention.

The exercise apparatus 10 may be incorporated into more complex exercise machines and apparatus that exploit the advantages of the present invention herein described. For example, referring to FIG. 9 there is provided an exercise machine 100 that comprises a frame 102. A pair of devices each comprising the exercise apparatus 10 are attached to the frame 102 at diagonally extending angles. A user may stand between the two devices 10.1, 10.2 and the support frame 102 in the area labelled 104. Facing away from the frame 102, the user may then hold on one or more of the handles 73.1, 73.2, 83.1, 83.2 of the two devices 10.1, 10.2 and push them away from the frame 102 to perform a range of resistance exercises.

Referring to FIGS. 10 to 15, an exercise apparatus 120 is shown according to a further example embodiment of the invention. The exercise apparatus 120 is materially the same as the exercise apparatus 10 depicted in FIGS. 1 to 7, except that the exercise apparatus 120 also comprises a tensioning mechanism 122 that is operatively configured to add tension to the cable assembly 22 of the apparatus 120. The tensioning mechanism may comprise a moveable pulley wheel 124 that engages an individual cable 126 of the cable assembly 22 to tension the cable 126. The pulley wheel 124 may be slidable along an elongate track 128 provided on the frame of the exercise apparatus 120. The cable 126 may extend underneath the pulley wheel 124 such that, in use, sliding the pulley wheel 124 downwardly along the track 128 causes tension to be added to the cable 126.

The pulley wheel 124 may be slidably connected to the track 128 by a bracket arrangement that comprises a locking mechanism for locking the pulley wheel 124 in position relative to the track 128. The locking mechanism may comprise a locking pin 130 slidably supported by the bracket arrangement that is releasably engageable into a plurality of apertures 132 provided on the track 128. The pin 130 may comprise a handle that is used to slide the pin 130 between an engagement condition, for engaging into one of the apertures 132, and a release condition for moving the bracket arrangement relative to the track 128. The pin 130 may be spring loaded to bias the pin 130 towards the engagement condition.

The tensioning mechanism 122 may also comprise an elongate screw thread 134 rotatably supported by the frame of the apparatus 120, wherein the screw thread 134 is received by a threaded aperture provided in the bracket arrangement. A handle 136 may also be provided at an end of the screw thread 134 for turning the screw thread 134. In use, turning the handle 136 causes the thread 134 to rotate about its longitudinal axis which, in turn, causes the bracket arrangement and pulley wheel 124 to travel along the track 128. When the pulley wheel 124 has been moved to a required height, thereby adding a required tension to the cable 126, the pulley wheel 124 may be locked in position using the locking pin 130.

The tensioning mechanism 122 may advantageously be used to tension the cable assembly 22 during use. The tensioning mechanism 122 may also be used to adjust the starting position of the piston 16 in each chamber 12 of the apparatus 120 that is connected to the second cable subassembly 36. The user may, therefore, advantageously use the tensioning mechanism 122 to add an initial starting resistance force that is exerted by each connected piston 16 on the cable assembly 22. It will be appreciated that when each piston 16 is located at the uppermost end of its chamber 12, there is no vacuum present above the piston 16 and no corresponding resistance force is provided by the piston 16. When the handle 136 is turned causing the pulley wheel 124 of the tensioning mechanism 122 to be lowered, each connected piston 16 is pulled by the cable assembly 22 downwardly through the relevant chamber 12 by a corresponding distance. This enables the user to add a starting resistance force exerted by each connected piston 16 on the cable assembly 22. The starting resistance force advantageously stops the various cables included in the cable assembly 22 from twisting relative to each other. Further, when the user of the apparatus 120 exerts an applied force on the cable assembly 22 in use, the applied force is immediately opposed by the resistance force. If the cable assembly 22 is slack, then no resistance force is exerted by the apparatus 10 at the instant when the applied force is first exerted by the user. By providing the initial resistance force, the resistance force that is experienced by the user against their applied force only varies by a negligible amount over the full range of motion. The tensioning mechanism 122 also enables the use to remove tension from the cable assembly 22 when the user wishes to alter the resistance setting of the apparatus 120.

Figure 14:
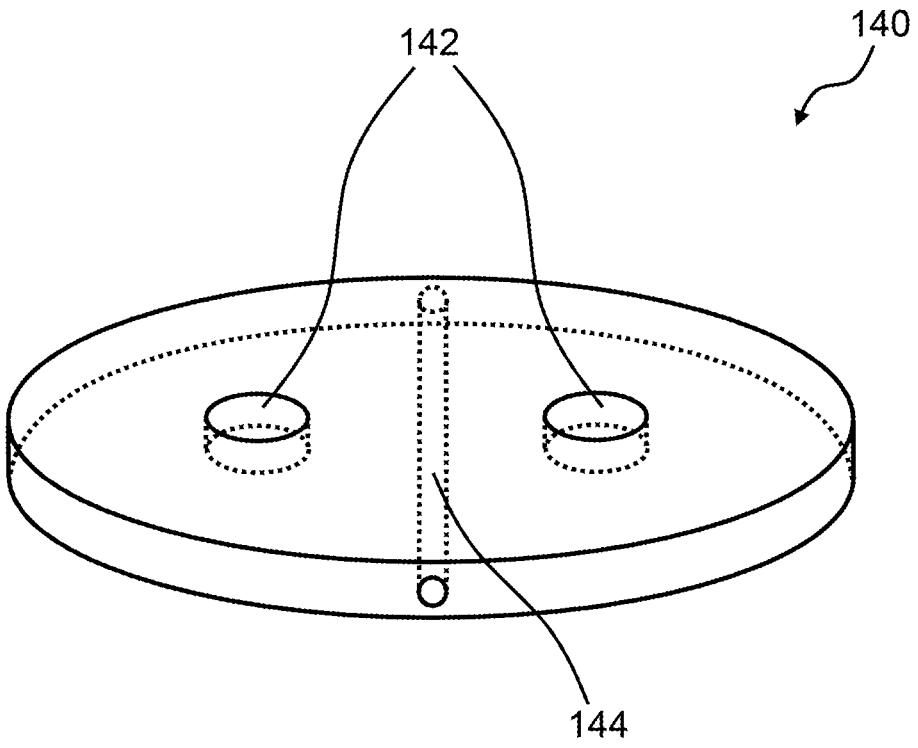
FIG. 14 is an isometric view of a circular cover provided in a chamber of the exercise apparatus of FIG. 10.
Figure 15:
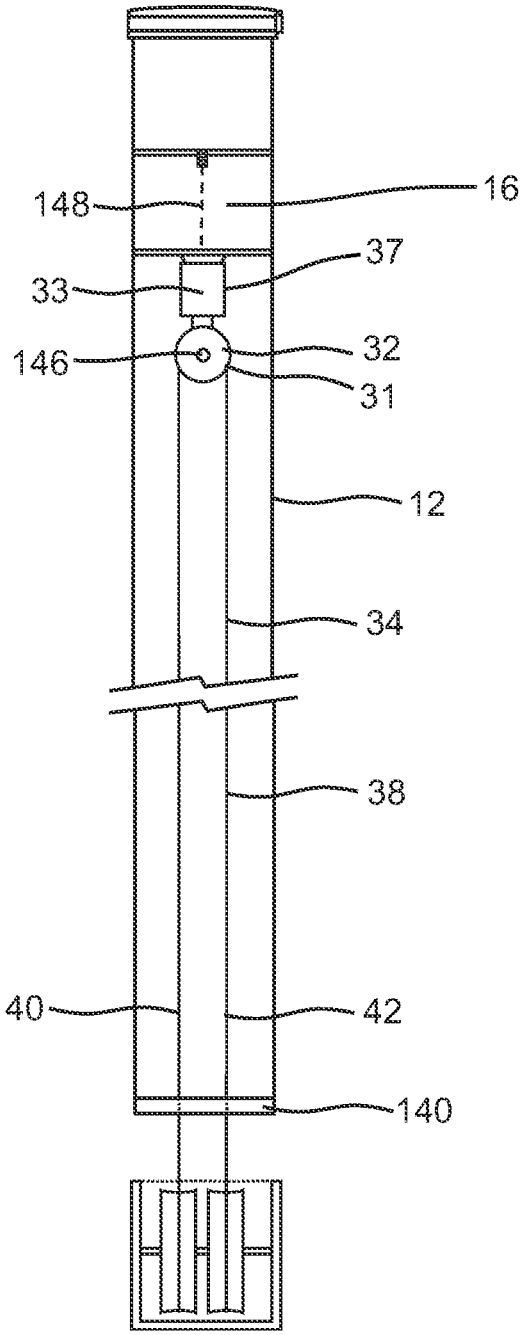
FIG. 15 is cross sectional side elevation view of an individual chamber of the exercise apparatus of FIG. 10.

Referring to FIGS. 14 and 15, each chamber 12 may also comprise a cover 140 that extends laterally across the internal cavity of the chamber 12 below the piston 16 at a lowermost end of the chamber 12. The cover 140 may comprise first and second apertures 142 that receive respectively the first and second cable lengths 40, 42 of the cable subassembly 34 attached to the piston 16 of the chamber 12. The cover 140 may also comprise an elongate rod 144 extending laterally between opposed sides of the cover 140. The rod 144 extends between the two apertures 142 and, therefore, bisects the two cable lengths 40, 42. The cover 140 advantageously retains the two cable lengths 40, 42 to prevent them from twisting relative to each other during use. The cover 140 also advantageously blocks the ingress of dust and dirt into the chamber 12.

The coupling device 37 that connects the pulley wheel 32 of each chamber 12 to the piston 16 of the chamber 12 may be configured such that the axle 146 of the pulley wheel 32 can swivel relative to the piston 16 about a longitudinal axis 148 extending vertically through the piston 16. For example, the coupling device 37 may comprise a cylindrical cavity provided with bearings that rotatably receives a spindle extending upwards from the pulley wheel 32. In this configuration, the pulley wheel 32 advantageously swivels into its correct orientation when the two cable lengths 40, 42 are put into tension.

Figure 10:
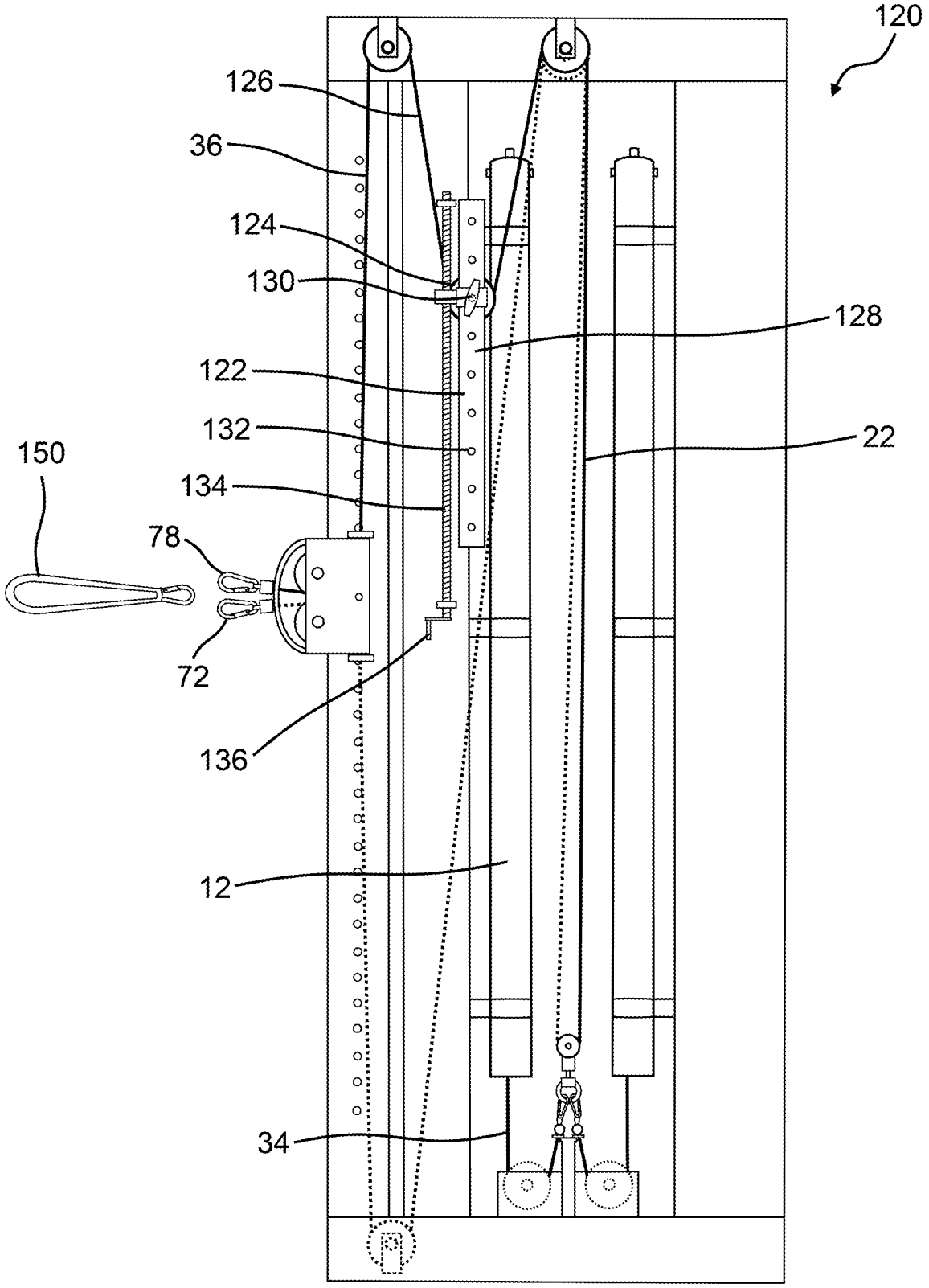
FIG. 10 is a first side elevation view of an exercise apparatus according to a further example embodiment of the invention.
Figure 11:
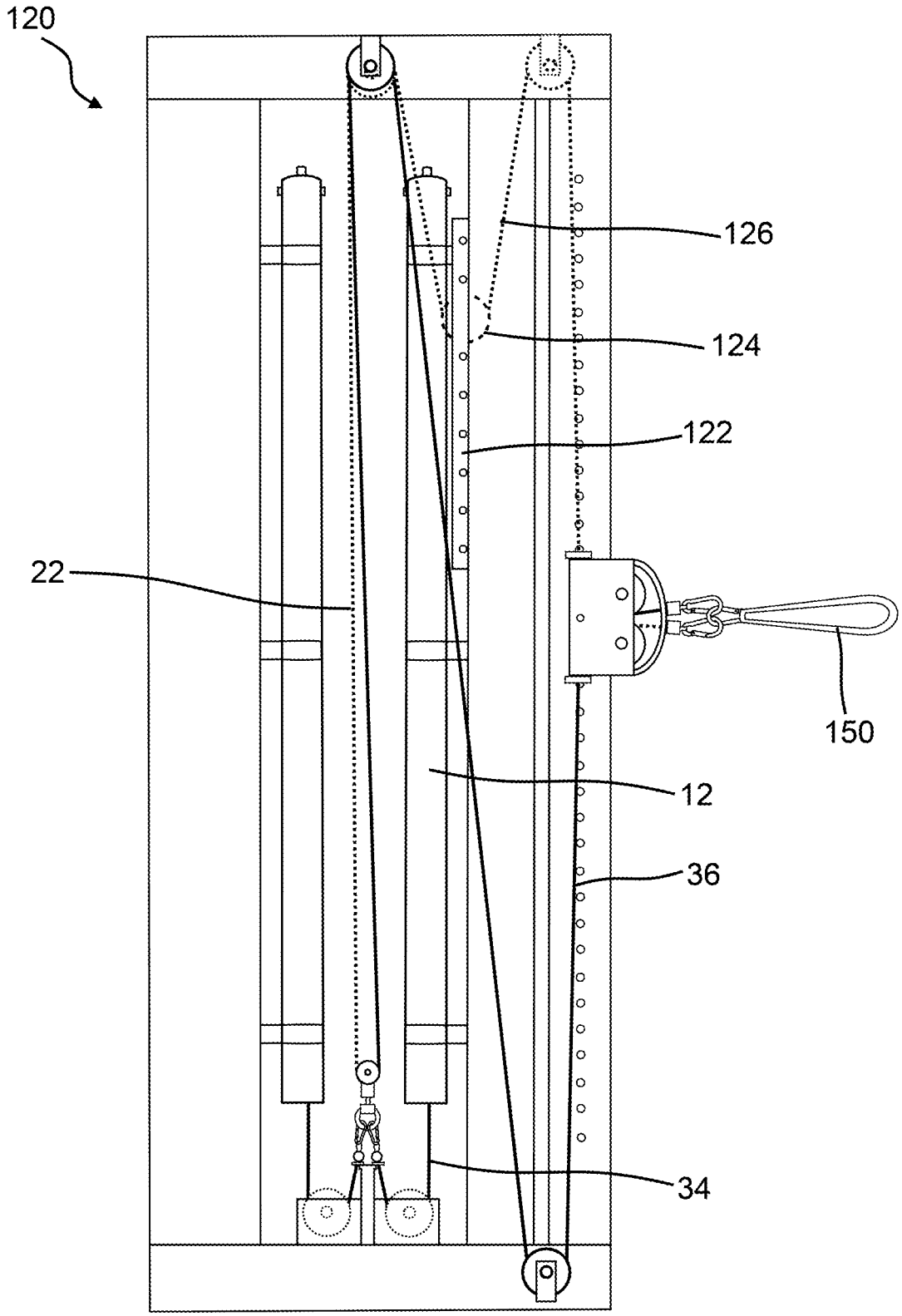
FIG. 11 is a second side elevation view of the exercise apparatus of FIG. 10.

As depicted in FIGS. 10 and 11, the apparatus 120 may also comprise a single handle 150 that is selectively connectable to two peripheral ends 72, 78 of the second cable subassembly 36 of the apparatus 120. More particularly, each end 72, 78 may be provided with a carabiner clip that is releasably connectable to a looped end of the handle 150. When the handle 150 is connected to both of the ends 72, 78, the effort that must be exerted by the user to overcome the resistance force provided by the apparatus 120 is substantially double the effort required when the handle 150 is connected to only one of the ends 72, 78.

Figure 12:
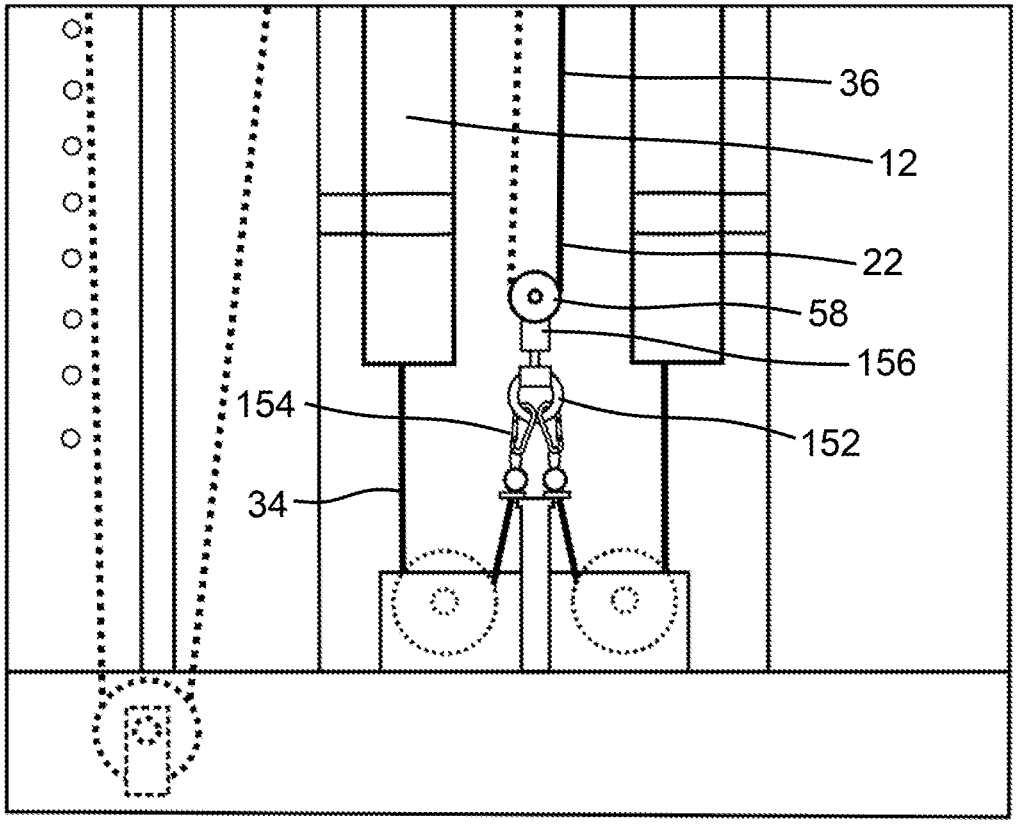
FIG. 12 is an enlarged side elevation view of a base end of the exercise apparatus of FIG. 10.

Referring to FIG. 12, the pulley wheel 58 of the second cable subassembly 36 may be connectable to the first cable subassembly 34 by a coupling arrangement that comprises a loop 152. The coupling arrangement may also comprise a clip 154, such as a carabiner clip, that is provided at the end of each cable length of each cable subassembly 34 extending out of each chamber 12. The pulley wheel 58 may be connected to the loop 152 by a swivel joint 156. The swivel joint 156 may comprise a cylindrical cavity provided with bearings that rotatably receives a spindle extending upwards from the loop 152. In this configuration, the pulley wheel 58 advantageously swivels into its correct orientation when the cable assembly 22 is put into tension.

Figure 13:
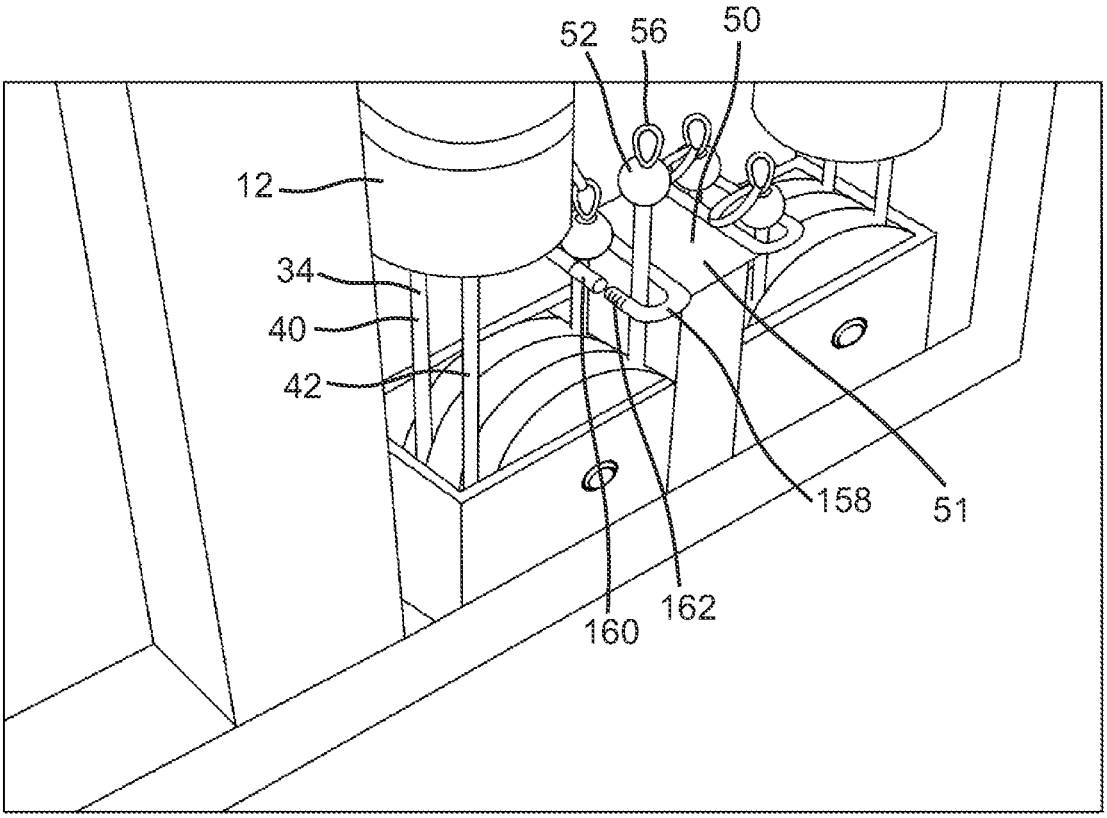
FIG. 13 is an enlarged perspective view of the base end of the exercise apparatus of FIG. 10.

Referring to FIG. 13, the first and second cable lengths 40, 42 of the first cable subassembly 34 may extend through a loop 158 that is provided on the support arrangement 51 of the apparatus 120. The loop 158 provides the bearing member of the support arrangement 51 and is operatively configured to restrain movement of the stopper 52 on the first cable length 40 when the second cable length 42 is pulled away from the loop 158 (and vice versa). The loop 158 may comprise a gate that allows the loop 158 to be opened and closed. For example, the gate may comprise an internally threaded sleeve 160 slidably connected to a first end of the gate. The sleeve 160 may receive and engage with an externally threaded second end 162 of the gate. When the gate is opened, the cable lengths 40, 42 can be conveniently threaded into and out of the loop 158 as required during assembly and maintenance of the apparatus 120.

In the examples depicted in FIGS. 1 to 15, each exercise apparatus comprises a pair of chambers 12. However, it will be appreciated that a larger or smaller number of chambers may be included in embodiments of the invention. For example, referring to FIG. 16, an exercise apparatus 170 is depicted according to a further example embodiment. The exercise apparatus 170 is materially the same as the exercise apparatus 120 depicted in FIG. 10 except that the apparatus 170 comprises a single chamber 172 secured to the frame 174 of the apparatus 170. The cable assembly of the apparatus 170 comprises a first cable subassembly 176 connected to the piston of the chamber 172 and a second cable subassembly 178 that extends between the first cable subassembly 176 and a handle 180 of the apparatus 170. The first cable subassembly 176 may comprise the same pulley wheel 32 and cable 38 arrangement included in the exercise apparatus 120 depicted in FIG. 10, wherein the ends of two cable lengths 40, 42 of the cable 38 are selectively attachable to the second cable subassembly 178 to allow the user to choose the level of effort required to move the piston.

In another example, in lieu of the pulley wheel 32 and cable 38 arrangement, the first cable subassembly 176 of the apparatus 170 may comprise a single cable (not shown) that is directly connected to the piston of the chamber 172. The single cable may extend out of the chamber 172 and comprise a peripheral end that is connected to the pulley wheel 182 of the second cable subassembly 178 by a coupling device. In such example, the two ends 184 of the second cable subassembly 178 that are selectively attachable to the handle 180 provide the sole means for allowing the user to choose the magnitude of the resistance force that is provided by the exercise apparatus 170 to the user.

Figure 16:
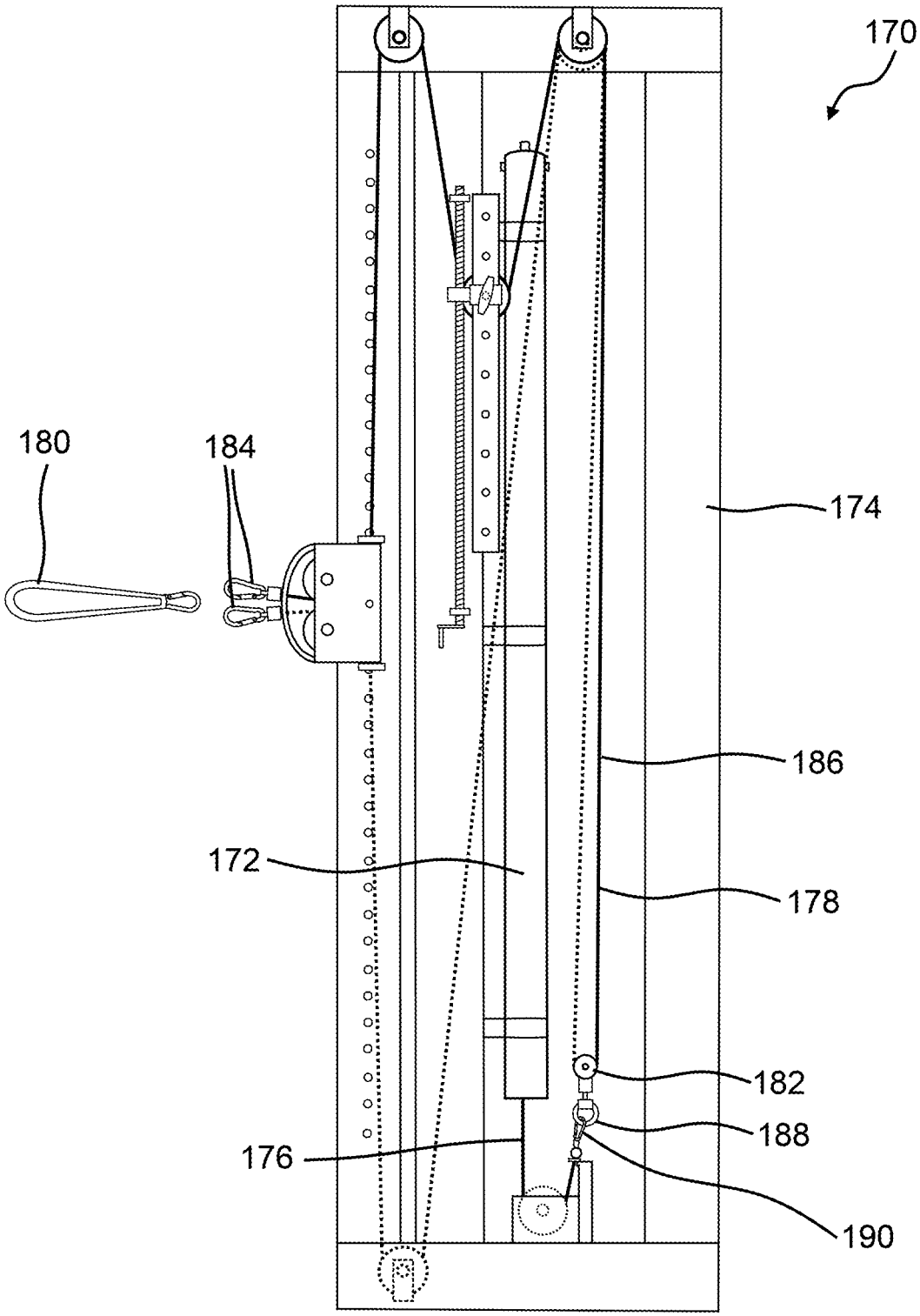
FIG. 16 is a side elevation view of an exercise apparatus according to a further example embodiment of the invention.

In another example, the first cable subassembly 176 of the apparatus 170 may comprise the pulley wheel 32 and cable 38 arrangement included in the exercise apparatus 120 depicted in FIG. 10. However, in lieu of the pulley wheel 182 and cable 186 arrangement that is depicted in FIG. 16, the second cable subassembly 178 may comprise a single cable (not shown) that extends directly between the loop 188 and the handle 180 of the apparatus 170. In such example, the two cable lengths 40, 42 of the first cable subassembly 176 that are selectively attachable to the loop 188 provide the sole means for allowing the user to choose the magnitude of the resistance force that is provided by the exercise apparatus 170 to the user. It will be appreciated that the carriage assembly will be statically mounted to the frame of the apparatus 170 in such example.

In further examples, the exercise apparatus may also be provided with an elastically stretchable band (not shown) that is attachable to first and second points on the cable assembly of the exercise apparatus. For example, referring to the apparatus 170 shown in FIG. 16, the band may be attached between the loop 188 and the clip 190 that is provided at either or both ends of the cable lengths 40, 42 of the first cable subassembly 176. The band may be used when the apparatus 170 needs to be converted to perform exercises that require a weak, variable resistance force to be exerted in response to applied forces of the user. This includes, for example, exercises performed for rehabilitation purposes and certain types of Pilates exercises.

Embodiments of the present invention provide exercise apparatus that are useful for performing resistance training exercises.

For the purpose of this specification, the word "comprising" means "including but not limited to", and the word "comprises" has a corresponding meaning.

The above embodiments have been described by way of example only and modifications are possible within the scope of the claims that follow.

The invention claimed is:

1. An exercise apparatus, comprising:

a frame;

at least one chamber supported by the frame, the chamber comprising an elongate internal cavity extending through the chamber;

a piston disposed in the internal cavity, wherein the piston is in a sealed airtight arrangement with an inner wall of the internal cavity and is adapted to slide back and forth between a first cavity end and a second cavity end of the internal cavity; and a cable assembly supported by the frame, wherein the cable assembly comprises a first end connected to the piston and at least a second end remote from the first end such that when an applied force is exerted on the second end, the piston is pulled by the cable assembly towards the second cavity end causing a vacuum to be created between the piston and the first cavity end, the vacuum thereby causing a resistance force that opposes the applied force to be exerted by the piston on the first end of the cable assembly, and wherein the cable assembly comprises at least one cable subassembly extending between first and second parts of the cable assembly, wherein the cable subassembly is configured to be pulled into tension by the applied force and by the resistance force and comprises:

a pulley wheel rotatably attached to the first part of the cable assembly;

a cable extending around the pulley wheel, wherein the cable comprises first and second cable lengths at respective opposed ends of the cable, wherein the cable lengths and the pulley wheel are arranged such that when either or both of the cable lengths is/are pulled relative to the pulley wheel, the cable causes the pulley wheel to move translationally relative to the frame and to exert a pulling force on the first part of the cable assembly;

first and second stoppers attached respectively to the first and second cable lengths, wherein at least the first of the stoppers is operatively configured to engage a surface of a support arrangement that is positioned relative to the frame, wherein the surface restrains translational movement of the first of the cable lengths relative to the frame when only the second of the cable lengths is pulled relative to the pulley wheel; and a clip configured to connect either or both of the cable lengths releasably to the second part of the cable assembly to allow a user of the exercise apparatus to choose a magnitude of the resistance force that is transferred to the second part of the cable assembly by the cable subassembly and experienced by the user against the applied force.

2. The exercise apparatus according to claim 1, wherein the pulley wheel is rotatably attached to the piston by a spindle extending from the pulley wheel into a cylindrical cavity in the piston, wherein the spindle and pulley wheel are dimensioned to fit inside the internal cavity and slide along the internal cavity with the piston, and wherein the cable lengths extend out from the chamber via an end of the chamber to connect to the second part of the cable assembly.

3. The exercise apparatus according to claim 2, wherein the first and second cable lengths extend around respectively first and second pulley wheels provided underneath the end of the chamber before extending to the second part of the cable assembly.

4. The exercise apparatus according to claim 3, wherein the first and second cable lengths extend through first and second apertures provided in the surface of the support arrangement.

5. The exercise apparatus according to claim 2, wherein the chamber comprises a cover extending laterally across the internal cavity below the piston, wherein the cover comprises first and second apertures that receive respectively the first and second cable lengths.

6. The exercise apparatus according to claim 2, wherein the spindle and the cylindrical cavity are together configured such that the pulley wheel can swivel relative to the piston about an axis extending longitudinally through the piston.

7. The exercise apparatus according to claim 2, wherein the second end of the cable assembly comprises a handle, and wherein the cable assembly also comprises a further cable subassembly that extends between the second part of the at least one cable subassembly and the handle, wherein the further cable subassembly is operatively identical to the at least one cable subassembly and comprises a further cable having first and second further cable lengths that are releasably connectable to the handle.

8. The exercise apparatus according to claim 7, wherein the exercise apparatus comprises a carriage assembly slidably supported by an elongate frame member of the frame, wherein the further cable lengths threadedly extend through the carriage assembly and are arranged such that the further cable stays extended around a pulley wheel of the further cable subassembly when the carriage assembly moves slidably along the elongate frame member.

9. The exercise apparatus according to claim 8, wherein the carriage assembly comprises a pop pin engageable into a plurality of apertures in the elongate frame member for locking the carriage assembly in position relative to the elongate frame member when the carriage assembly has been moved to a desired height.

10. The exercise apparatus according to claim 8, wherein the further cable lengths extend away from the carriage assembly in opposed directions and around at least a pair of pulley wheels disposed at, respectively, upper and lower ends of the frame, and wherein the further cable lengths are continuously joined and extend around the pulley wheel of the further cable subassembly.

11. The exercise apparatus according to claim 1, wherein the exercise apparatus comprises a moveable pulley wheel that engages an individual cable of the cable assembly to tension the individual cable.

12. The exercise apparatus according to claim 11, wherein the moveable pulley wheel is slidable along an elongate track provided on the frame.

13. The exercise apparatus according to claim 12, wherein the moveable pulley wheel is slidably connected to the elongate track by a bracket arrangement.

14. The exercise apparatus according to claim 13, wherein the bracket arrangement comprises a pin that is slidably supported by the bracket arrangement, wherein the pin is releasably engageable into a plurality of apertures provided on the elongate track for locking the moveable pulley wheel in position relative to the elongate track.

15. The exercise apparatus according to claim 14, wherein the pin is slidable between an engagement condition for engaging with one of the apertures provided on the elongate track and a release condition for moving the bracket arrangement relative to the elongate track, and wherein the pin is spring loaded to bias the pin towards the engagement condition.

16. The exercise apparatus according to claim 13, wherein an elongate screw thread is rotatably supported by the frame, wherein the elongate screw thread is received by a threaded aperture provided in the bracket arrangement.

17. The exercise apparatus according to claim 16, wherein the elongate screw thread comprises a handle for turning the elongate screw thread.

18. The exercise apparatus according to claim 1, wherein the exercise apparatus further comprises:

a second chamber supported by the frame, the second chamber comprising an elongate internal cavity extending through the second chamber;

a further piston disposed in the internal cavity of the second chamber, wherein the further piston is in a sealed airtight arrangement with an inner wall of the internal cavity of the second chamber and is adapted to slide back and forth between a first cavity end and a second cavity end of the internal cavity of the second chamber, wherein the cable assembly comprises a further cable subassembly for releasably connecting the further piston to the second end of the cable assembly.

19. The exercise apparatus according to claim 1, wherein the cable lengths of the cable subassembly are releasably connectable to a handle of the exercise apparatus.

20. An exercise machine comprising a pair of exercise devices connected together, wherein each of the exercise devices comprises the exercise apparatus according to claim 1.

* * * * *